United States Patent [19]

Jackson

[11] 3,936,020

[45] Feb. 3, 1976

[54] KITE CONSTRUCTION

[76] Inventor: Andrew W. Jackson, 214½ E. Main, Walla Walla, Wash. 99362

[22] Filed: Aug. 3, 1973

[21] Appl. No.: 385,286

[52] U.S. Cl. ..... 244/153 R
[51] Int. Cl.² ..... B64C 31/06
[58] Field of Search ..... 244/153 R, 154

[56] References Cited

UNITED STATES PATENTS

| | | | |
|---|---|---|---|
| 2,057,148 | 10/1936 | Hopkins et al. | 244/153 R |
| 2,463,135 | 3/1949 | Bach | 244/153 R |
| 3,055,622 | 9/1962 | Harmon | 244/153 R |
| 3,276,730 | 10/1966 | Cleveland | 244/153 R |
| 3,790,112 | 2/1974 | Holland, Jr. | 244/153 R |

FOREIGN PATENTS OR APPLICATIONS

| | | | |
|---|---|---|---|
| 958,172 | 3/1950 | France | 244/153 R |

*Primary Examiner*—Trygve M. Blix
*Assistant Examiner*—Paul E. Sauberer

[57] ABSTRACT

A highly aerodynamically stable kite having a flexible statically indeterminate face which during flight forms a curvilinear airfoil that is maintained in the center and top edges by rigid linear stiffeners removably retained in a novel nosepiece. The nosepiece is a rigid three dimensional structure formed by folding a thin flat pattern. A novel tail member aids kite stability by providing plural aerodynamically rotatable elements spacedly depending beneath the kite upon a common flexible line.

3 Claims, 4 Drawing Figures

KITE CONSTRUCTION

BACKGROUND OF INVENTION

A. Related Applications

There are no applications related hereto now filed in this or any foreign country.

B. Field of Invention

My invention relates generally to aerodynamically stable kites and more particularly a statically indeterminate kite structure stabilized by plural rotatable tail elements.

C. DESCRIPTION OF PRIOR ART

Kite art may be divided for convenient analysis into a first class of kites requiring no tail and a second class which utilizes a tail either as a primary stabilization device or secondarily to stabilize in conjunction with kite shape. This second class is distinguished into subgroups: the first including those kites having flat aerodynamic surfaces such as box kites; the second including kites having airfoils of curvilinear cross-section which are pre-formed to shape — generally as a single airfoil such as the common stressed "T" stick paper kite; and the third sub-group, and that in which this invention falls, including kites which provide a free form or statically indeterminate aerodynamic configuration.

The distinction between members of the different classes is obvious. Within its sub-class my kite provides a shape somewhat similar to prior art kites but somewhat longer and narrower as allowed by the interaction of the tail members which provides stability not found in the prior art.

My kite differs from the prior art of its class primarily in tail design and in construction features of the kite itself. Rigid supporting framework normally used in kite construction provides taping or other similar joinder techniques at points of intersection of framework elements and for joinder of surface material to framework. My kite construction does not join supporting framework elements together per se and so eliminates these typically complex and weak intersections. I interweave the supporting framework into the surface material itself through appropriately spaced cuts therein to eliminate surface framework joinder problems. To accomplish this weaving the face material between alternate pairs of slits is positioned on the first side of a spar and the interweaving material on the opposite side of the spar as it is inserted into the slit group. I provide a nose-piece formed by folding a flat pattern into a rigid box-like structure having slotted openings to releasably receive the various framework elements positionally to support these elements while they at the same time support and maintain the nose-piece structure.

Kite tails of the prior art normally have provided an elongate, flexible depending element such as knotted cloth which stabilizes the kite it serves only by its mass. Some few prior art tails have provided a rotational element generally as an aesthetic or novelty feature, still however, stabilizing only because of their appropriately positioned mass and bulk. My tail, in counter-distinction, on the other hand, provides plural spaced rotatable propeller-like elements journaled on a flexible line depending from the kite to provide not only traditional mass stabilization but also additional aerodynamic drag which normally increases during period of kite instability caused by turbulance. My invention provides a flexible planar surface member of diamond shape having a plurality of lineally aligned spaced parallel cuts along the vertical center axis and inwardly adjacent each of the top edges. The rigid elongate support elements are joined to the top edges. The rigid elongate support elements are joined to the surface member by weaving through the relieved portion formed by the cuts. A rigid nose-piece is fabricated from flat material to provide a triangular box-like structure with slots to releasably receive and positionally maintain the support elements at their proximate ends so that the support elements are maintained as cantilevered beams positioned to maintain the kite surface nearly flat, but still allowing the face to deflect somewhat between adjacent sticks.

My tail provides a flexible elongate cord depending from the bottom of the center stick somewhat more than the height of the kite. Plural propeller elements are rotatably carried by this cord at spaced intervals along its length for rotation normal thereto.

In providing such a device, it is:

A principal object of my invention to create a kite having great inherent aerodynamic stability caused by the combination of a flexible statically indeterminate kite surface with a particular tail configuration.

A further object of my invention to provide such a kite with an elongate tail providing plural spaced rotatable propeller-like elements to provide a stabilizing force greater than its mass alone would provide and one that increases with turbulance.

A further object of my invention to provide such a kite that is easily assembled by releasable joinder of elements, from components that can be stored in a minimal area.

A still further object of my invention is to provide such a kite that is of new and novel design, of rugged and durable nature, of simple and economic manufacture and one otherwise well adapted to the uses and purposes for which it is intended.

Other and further objects of my invention will appear from the following specification and accompanying drawings which form a part hereof. In carrying out the object of my invention, however, it is to be understood that its essential features are susceptible to change in design and structural arrangement with only one preferred and practical embodiment being set forth in the accompanying drawings as required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
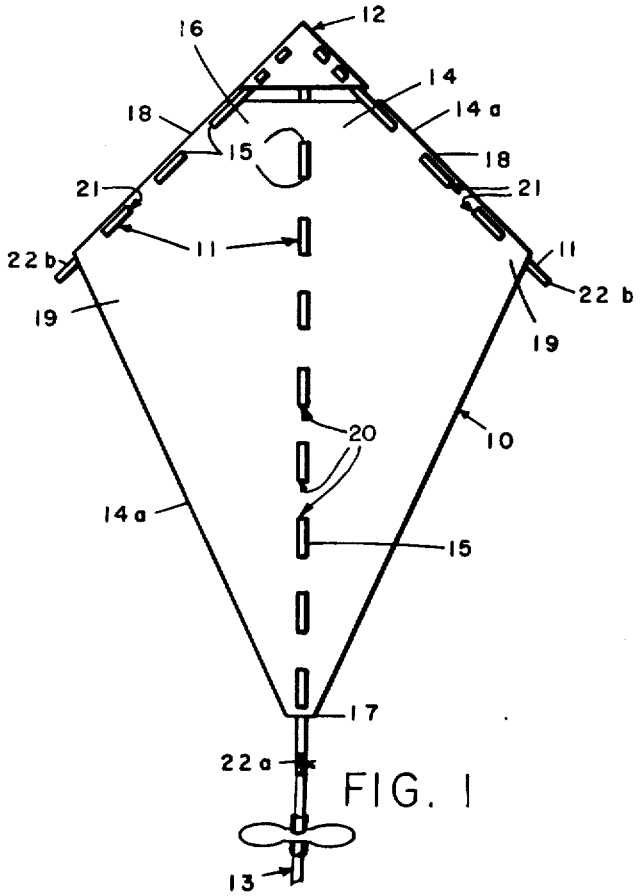
FIG. 1 is an orthographic plan view of the kite body of my invention showing its elements, their configuration and relationship.
Figure 2:
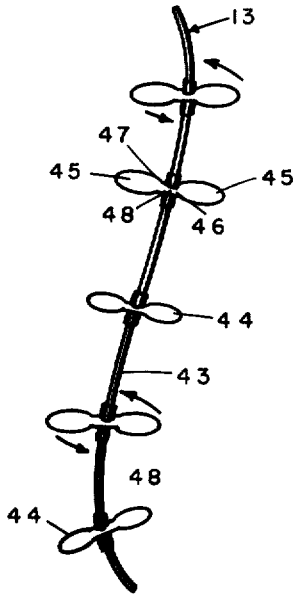
FIG. 2 is an isometric view of the tail of my kite.

Referring now to the drawings in more detail it will be seen that my invention comprises generally a kite body having surface member 10 carried by support elements 11 which are positionally maintained in the nose-piece 12 and carry depending tail member 13.

Surface member 10 provides a planar, generally quadrilateral element 14 fabricated from a light weight flexible material having sufficient tear resistance to withstand unstable aerodynamic buffeting. Thin kraft-type paper or one of the poly-vinyl sheet plastic materials will serve well as surface material. In the embodiment illustrated the surface geometry is lozenge-like similar to standard kites commonly known in commerce.

The peripheral edge portion 14*a* of the surface member may be folded inwardly and fastened to provide a more finished edge of greater strength, especially where the upper edges are slit. Plural spaced parallel slits 15 in surface 14 are formed linearly along the longitudinal axis between upper apex 16 and lower apex 17 and inwardly adjacent the upper sides 18 of the surface element between upper apex 17 and lateral extremities 19. Slits of the center slit group 20 are aligned perpendicular to the kite's longitudinal axis and the slits of the side slit group 21 are aligned perpendicular the sides they are adjacent to. The size and location of these slits must be such to allow support spars to be woven therethrough but otherwise depends on the particular face geometry; strength of materials and support size. Those shown in the drawing are suggestive and not meant to be exclusive. The upper and lower apex of the kite surface are preferably truncated to facilitate joinder of the other elements as shown in FIG. 1.

Support elements 11 comprise elongate linear spars 22 of a size appropriate to be woven through slits 15. These members may be formed of any rigid material of sufficient strength to withstand dynamic pressure incurred in kite flight; wood or modern plastics serve my purposes well. In the embodiment shown, center spar 22*a*is of a length slightly longer than the longitudinal dimension of the kite and is joined thereto by weaving into the center slit. To accomplish this weaving the face material between alternate pairs of slits is positioned on the first side of a spar and the interweaving material on the opposite side of the spar as it in inserted into the slit group. The resultant joinder of spar and surface is maintained by friction engagement between the members and yet is easy to assemble or disassemble and requires no secondary fastening as by tying or stapling. Side spars 22*b* are slightly longer than upper edges 18 of the surface 14 and are installed and maintained in side slits 21 in a manner similar to that employed for the center spar. The particular support elements described in the specific embodiment are not meant to be limiting and other types or arrangements of support elements could be substituted therefore without altering the essence of this invention. For instance the spars well could be curvilinear and still allow a bellowing type of support for the kite surface or the kite surface could be differently shaped within limits of the construction described.

Figure 3:
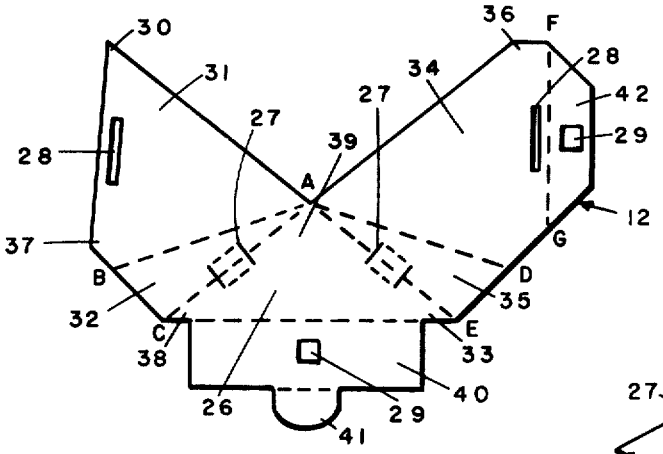
FIG. 3 is an orthographic plan view of the flat pattern of the nose-piece of my kite.
Figure 4:
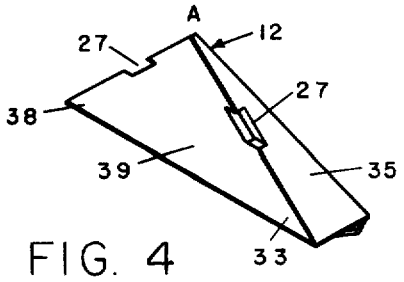
FIG. 4 is an isometric view of the nose-piece of FIG. 3 folded into its erected configuration.

Nose-piece 12 is a triangular box-like structure which supports the spars 22 in a radiating fashion as illustrated to provide the kite with its ultimate air foil shape and complete the upper portion of that shape. The nose-piece is constructed from the flat pattern element 26 shown in FIG. 3, which in this instance is fabricated from medium weight laminated cardboard. Paired opposed spar orifices 27 are formed in the center portion and elongate slots 28 are formed inwardly adjacent the edge of each lateral portion 31, 34 as illustrated in FIG. 3. Orifices 29, of a configuration to frictionally receive spar elements 22 are positioned on the end flaps as shown. To form the erected nosepiece as shown in FIG. 4, flap 31 is folded downwardly (with reference to the positioning shown in the drawings) 90° on a line A–B and end 32 is folded downward 90° on line A–C to bring corner 30 directly beneath corner 33. Similarly flap 34 is folded downward 90° on line A–D and end 35 is folded downwardly 90° on line A–E to bring corner 36 directly beneath corner 37 on flap 31 and corner 38 on front 39. Bottom 40 is then folded downward 90° and tab 41 is inserted into now aligned slots 28 to secure the nose-piece in its folded position. Lip 42 is then folded upward along line F–G to a position adjacent bottom 40 to complete the nose-piece erection.

Tail member 13 provides elongate flexible line 43, in this instance constructed from round rope approximately the length of the longer kite dimension. Plural propeller-like elements 44, comprising substantially planar opposed symmetrical end portions 45 joined by narrower center portion 46 with hole 47 therein, are rotatably carried by plural spaced bearings 48 fixedly attached to line 43 to allow propeller rotation but provide longitudinal restraint. The bearings 48 are of the known simple bushing type with end restraints to maintain a propellor in rotatable position thereon. The propeller blades may be turned at an angle to the center part to give them an agle of attack to further aid their rotation. The uppermost portion of line 43 is attached to the lower end of spar 22*a* by known means such as tying to allow the remainder to depend therefrom.

Having thusly described my invention, its operation may now be understood.

Firstly a kite and tail assembly are formed according to the foregoing specification. It is to be noted that the particular shape of the kite is not essential though the configuration of the other elements do relate somewhat to the kite shape chosen.

To assemble the kite center spar 22*a* is inserted into holes 29 and side spars 22*b* are inserted into slits 27 of nose-piece 12 with a sufficient portion of the sticks extending into the nose to provide rigid support. Holes 29 and slits 27 are sized such that the spars must be inserted with some force so that they will thereafter be frictionally maintained. The nose-piece is constructed so that the spars extend therefrom in co-planar fashion with the side spars at similar acute angles to the center spar. This angle will be such that when the spars are inserted into the surface of the kite, the surface will not be taut but sufficiently loose to deflect somewhat between adjacent spars. In flight this deflected portion acts as an air foil to catch the wind and aid lift to a greater degree than with a planar face.

Each tail propeller 44 provides an increment of drag which tends to increase during periods of turbulence to give greater stability at such times. A substantial number of propellers may be provided on the tail line which is somewhat longer than normal to give an appropriate drag for stability to a kite of similar size. These rotational tail elements also provide a unique aesthetic appearance unavailable with known tails.

Flight is attained by joinder of the center spar, in its upper part, to an appropriate length of string and launching the kite into the wind as is normally done with present day kites of commerce. In flight the complex surface portion of my kite catches the wind to form air foils that provide more lift than a simple planar surface. The propeller elements provide drag to maintain the kite's angle of attack and provide additional sidewise stability against yawing that normally occur in flying prior art kites.

The foregoing description of my invention is necessarily of a detailed nature so that a specific embodiment of it might be set forth as required but it is to be understood that various modifications of detail, arrangement and multiplication of parts may be resorted to without departing from its spirit, essence or scope.

Having thus described my invention, what I desire to protect by Letters Patent, and

What I claim is:

1. A statically indeterminable kite, comprising in combination:

a thin surface element of flexible material of general lozenge-like shape having an axis of symmetry through the diagonal with at least a plurality of spaced parallel slits extending perpendicularly to and on both sides of the axis of symmetry and a plurality of spaced parallel slits lineally aligned substantially perpendicular to and immediately inwardly adjacent two adjacent sides that communicate with the diagonal coincident with the axis of symmetry, which cooperate to form the nose-piece of the kite;

elongated rigid support elements carried in each lineal array of slits by weaving therethrough with face material between the slits alternately on one side and then the other of each support element, each of said support elements being somewhat longer than the slit array to project slightly therebeyond at least at the nose-piece end; and a three dimensional semi-rigid nose-piece having a plurality of positioned orifices therein to slideably receive and frictionally maintain the nose-piece ends of the support elements.

2. The invention of claim 1 further characterized by a tail member:

depending from the end of the rigid support coincident with the axis of symmetry at its end opposite the nose-piece;

comprising an elongate flexible line having a plurality of propeller-like elements journaled thereon at spaced intervals for rotation.

3. The invention of claim 1 wherein:

the rigid support elements are so positioned as to maintain the surface in a loose condition so that it may billow somewhat between supports during flight to create and maintain complex air foil configurations in the surface.

* * * * *